US009731955B2

(12) United States Patent
Callaghan et al.

(10) Patent No.: US 9,731,955 B2
(45) Date of Patent: Aug. 15, 2017

(54) MIXED LIQUID DISPENSING SYSTEM

(71) Applicant: Global Agricultural Technology and Engineering, LLC, Vero Beach, FL (US)

(72) Inventors: Gillian Callaghan, Wellesley, MA (US); Peter Brooke, Micco, FL (US); Michael Cheney, Vero Beach, FL (US); John Newton, Vero Beach, FL (US)

(73) Assignee: GLOBAL AGRICULTURAL TECHNOLOGY AND ENGINEERING, LLC, Vero Beach, CA (US)

( * ) Notice: Subject to any disclaimer, the term of this patent is extended or adjusted under 35 U.S.C. 154(b) by 0 days.

(21) Appl. No.: 14/894,650

(22) PCT Filed: May 27, 2014

(86) PCT No.: PCT/US2014/039586

§ 371 (c)(1),
(2) Date: Nov. 30, 2015

(87) PCT Pub. No.: WO2014/197238

PCT Pub. Date: Dec. 11, 2014

(65) Prior Publication Data

US 2016/0107873 A1 Apr. 21, 2016

Related U.S. Application Data

(60) Provisional application No. 61/830,245, filed on Jun. 3, 2013.

(51) Int. Cl.
*B67D 1/08* (2006.01)
*B67D 1/04* (2006.01)
(Continued)

(52) U.S. Cl.
CPC ..... *B67D 1/04* (2013.01); *B67D 1/0035* (2013.01); *B67D 1/0462* (2013.01);
(Continued)

(58) Field of Classification Search
CPC ..... B67D 2001/0828; B67D 1/0462; B67D 1/0035; B67D 1/04; B67D 1/1279;
(Continued)

(56) References Cited

U.S. PATENT DOCUMENTS 3,057,517 A 10/1962 Douglas
5,240,144 A * 8/1993 Feldman ..... B67D 1/0001 222/105

(Continued)

FOREIGN PATENT DOCUMENTS

FR 2623488 A1 5/1989

OTHER PUBLICATIONS

The International Search Report and Written Opinion mailed on Sep. 24, 2014 in connection with PCT Application No. PCT/US14/39586.

(Continued)

*Primary Examiner* — Paul R Durand
*Assistant Examiner* — Robert Nichols, II
(74) *Attorney, Agent, or Firm* — Gesmer Updegrove LLP

(57) ABSTRACT

A liquid mixing and dispensing system comprises a housing enclosing a chamber containing multiple containers, a flexible bag is in each of the containers. The flexible bags contain first liquids. Connecting conduits lead from the bags to a discharge conduit. A supply conduit is configured and arranged to supply a pressurized second liquid to the containers and to the discharge conduit. The pressurized second liquid serves to collapse the bags and eject the first liquids
(Continued)

from the bags and via the connecting conduits into the discharge conduit for mixture with the first liquid.

9 Claims, 2 Drawing Sheets

(51) Int. Cl.
*B67D 1/12* (2006.01)
*B67D 1/00* (2006.01)

(52) U.S. Cl.
CPC ..... *B67D 1/0884* (2013.01); *B67D 1/12* (2013.01); *B67D 1/1279* (2013.01); *B67D 2001/0093* (2013.01); *B67D 2001/0828* (2013.01); *B67D 2210/0006* (2013.01); *B67D 2210/00123* (2013.01)

(58) Field of Classification Search
CPC ..... B67D 1/0022; B67D 83/14; B67D 1/12; B67D 2001/0093; B67D 2010/00123; B67D 2210/0006; B67D 1/0884
USPC .... 222/394, 389, 144.5, 129, 105, 395, 131, 222/386.5, 136, 94, 95
See application file for complete search history.

(56) References Cited

U.S. PATENT DOCUMENTS 5,899,362 A 5/1999 Moran
6,026,850 A 2/2000 Newton et al.
6,209,578 B1 4/2001 Newton
6,848,599 B2 * 2/2005 Hammarth ..... B05B 1/3046 222/105
7,086,566 B2 * 8/2006 Goepfert ..... B67D 1/0007 222/135
7,451,895 B2 11/2008 Newton
7,617,839 B2 11/2009 Newton
8,136,698 B1 * 3/2012 Beaulieu ..... B05B 7/0408 222/105
2003/0173376 A1 * 9/2003 Bilskie ..... B67D 1/0406 222/129.1
2006/0086753 A1 * 4/2006 Newton ..... B01F 5/0496 222/105
2010/0147871 A1 * 6/2010 Haas ..... B67D 1/0462 222/1
2015/0028052 A1 * 1/2015 Rasmussen ..... B67D 1/0081 222/1

OTHER PUBLICATIONS

International Preliminary Report on Patentability issued in connection with corresponding PCT Application No. PCT/US2014/039586, mailed on Dec. 17, 2015.

* cited by examiner

MIXED LIQUID DISPENSING SYSTEM

PRIORITY INFORMATION

The present application is a 371 Application of PCT/US2014/038158 filed on May 27, 2014 that claims priority to U.S. Provisional Application Ser. No. 61/830,245, filed on Jun. 3, 2013. Both applications are incorporated herein by reference in their entireties.

BACKGROUND

1. Field

Embodiments of the present invention relate generally to liquid mixing and dispensing systems, and are concerned in particular with packaged systems that may be portable and/or disposable.

2. Description of Related Art

In a known liquid mixing and dispensing system disclosed in U.S. Pat. No. 7,451,895, flexible bags containing liquid concentrates are enclosed in a container closed by a cap. A manifold in the cap has metered inlet orifices communicating with the flexible bags and with the container interior. Pressurized liquid, e.g. a water diluent, is admitted into the container. The water collapses the bags causing the liquid concentrates to be ejected into the manifold. Water enters the manifold from the container and combines with the liquid concentrates to provide a liquid mixture delivered from a manifold outlet.

When mixing and dispensing liquid components of a beverage, and because the water diluent enters the manifold from the container, the entire container interior must first be sterilized and then kept free of contaminants during assembly of the system components. Sterilization contributes disadvantageously to the overall cost of the system, and contaminant free assembly is difficult to achieve reliably.

SUMMARY

Broadly stated, embodiments of the present invention address the above described problem, while additionally providing other advantages not offered by known systems.

DETAILED DESCRIPTION

Figure 1:
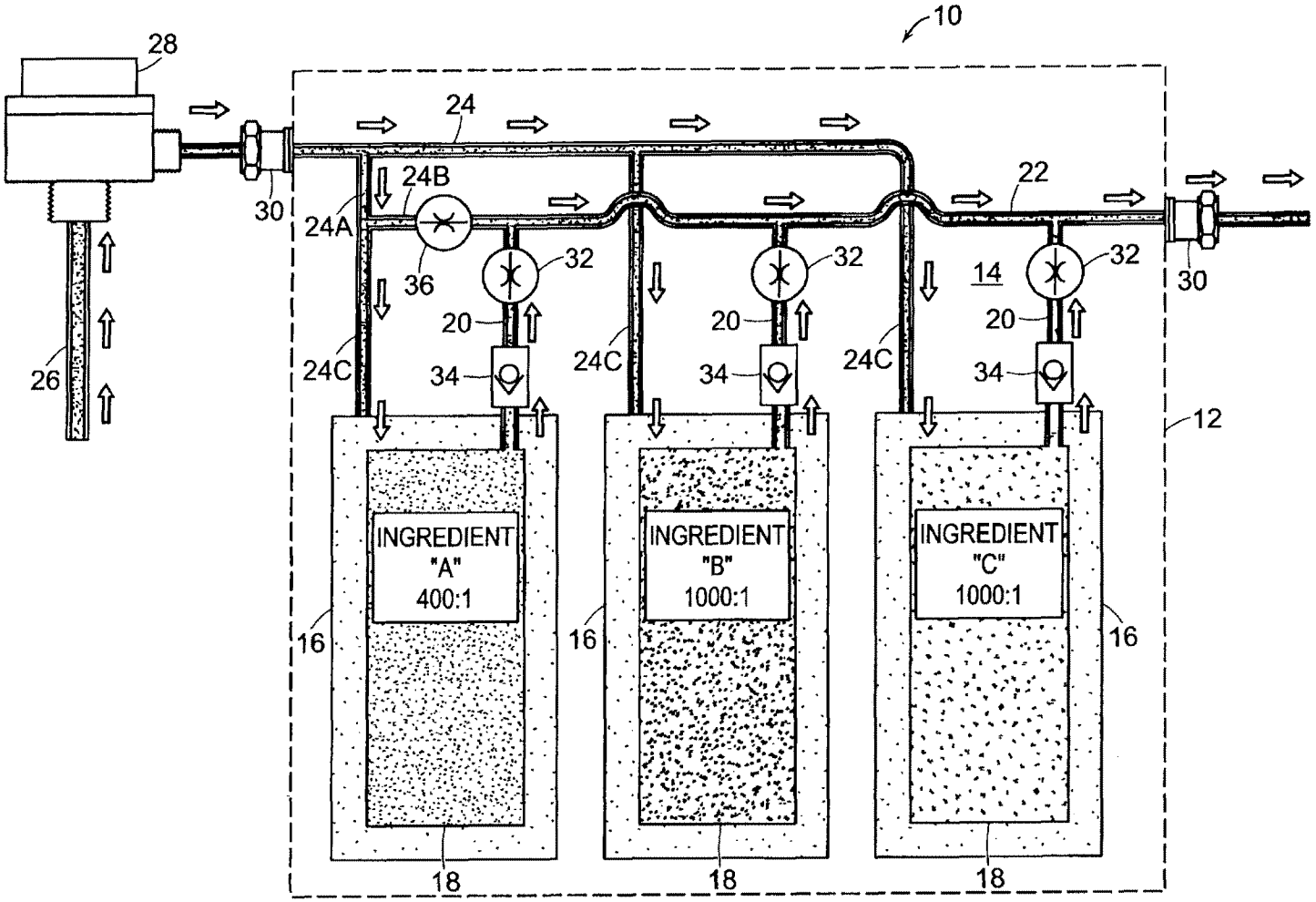
FIG. 1 is a diagrammatic illustration of a liquid mixing and dispensing system in accordance with an exemplary embodiment of the present invention.

With reference initially to FIG. 1, a liquid mixing and dispensing system is shown at 10. The system comprises a housing 12 enclosing a chamber 14. Multiple containers 16 are arranged in the chamber. Flexible sealed bags 18 are in each of the containers. The bags contain first liquids to be dispensed via connecting conduits 20 to a discharge conduit 22. A supply conduit 24 is configured and arranged to supply a pressurized second liquid to the discharge conduit 22 via branch conduits 24*a*, 24*b*, and to the containers 16 via branch conduits 24*c*. The pressurized second liquid serves to collapse the bags 18, causing the first liquids to be ejected via the connecting conduits 20 into the discharge conduit 22 for mixture with the second liquid.

The first liquids may be concentrated components of a beverage, and the second liquid may be a diluent, typically water received via conduit 26 from a variable pressure municipal source.

A constant flow valve 28 may be employed to maintain the pressure of the second liquid being delivered to the discharge conduit 22 and to the containers 18 at a substantially constant level.

As herein employed, the term "constant flow valve" means a flow control valve of the type described, for example, in any one of U.S. Pat. Nos. 7,617,839; 6,026,850 or 6,209,578, the descriptions of which are herein incorporated by reference in their entirety. These types of valves are normally closed, are opened in response to pressures exceeding a lower threshold level, are operative at pressures between the lower threshold level and an upper threshold level to deliver liquids at a substantially constant pressures, and are again closed at pressures above the upper threshold level.

Quick disconnect couplings 30 outside of the housing 12 may provide connections between the supply conduit 24 and the constant flow valve 28, and between the discharge conduit 22 and a remote dispenser or other delivery system (not shown).

Fixed metering orifices 32 and check valves 34 may be provided in the connecting conduits 20, and an additional fixed metering orifice 36 may be provided in the branch line 24*b* leading to the discharge conduit 22.

The housing 12 may comprise a shipping carton, which may be disposable along with its contents after the first liquids in the bags 18 have been exhausted.

Figure 2:
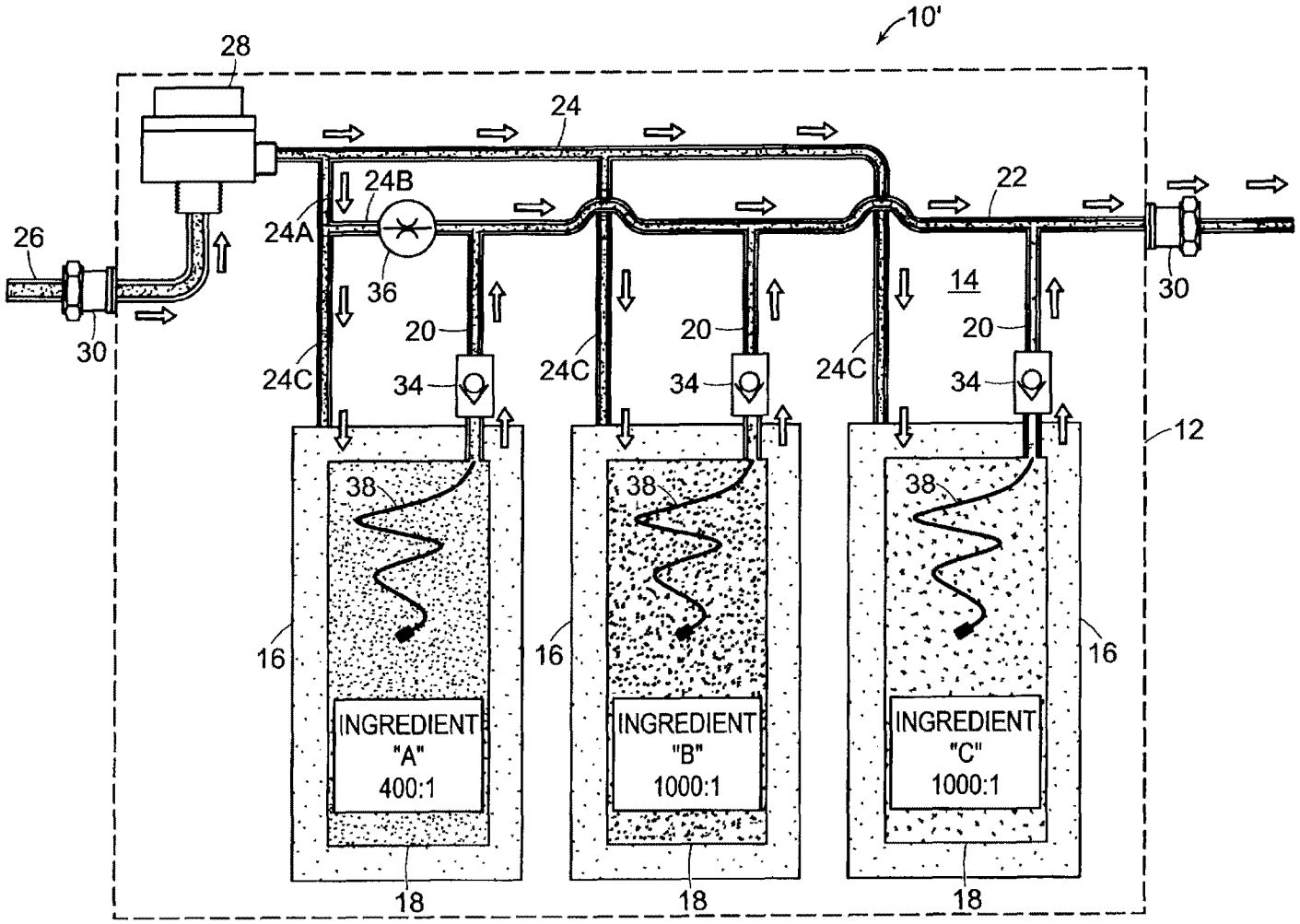
FIG. 2 is a diagrammatic illustration of an alternative embodiment of a liquid mixing and delivery system in accordance with an exemplary embodiment of the present invention.

A similar mixing and delivery system is disclosed at 10' in FIG. 2, with the following differences:

a) the constant flow valve 28 is arranged inside rather than outside of the housing 12; and b) The fixed metering orifices 32 of FIG. 1 have been replaced by tube orifices 38 in the collapsible bags 18. The lengths and/or internal sizes of the tube orifices 38 provide flow resistances comparable to the metering orifices 32, and are particularly suited for the metering of liquids having high viscosities and/or elevated levels of particulates.

In each of the above described embodiments, the contents of the sealed bags 18 are isolated from the pressurized liquid being fed into the containers 18. Thus, and in particular when the bags contain liquid beverage components, there is no need to sterilize the containers.

What is claimed is:

1. A liquid mixing and dispensing system comprising:

a housing enclosing a chamber;

multiple containers in said chamber;

a flexible bag in each of said containers;

a plurality of first liquids in said flexible bags;

connecting conduits leading from said flexible bags to a discharge conduit; check valves in said connecting conduits for preventing reverse liquid flow from said supply conduit into said flexible bags; and a constant flow valve through which a pressurized second liquid is delivered via a supply conduit to said containers and to said discharge conduit, said constant flow valve being normally closed, being opened in response to second liquid pressures above a lower threshold level, being operative at second liquid pressures between said lower threshold level and an upper threshold level to deliver said second liquid at a substantially constant pressure, and being closed in response to second liquid pressures above said upper threshold level, said pressurized second liquid serving to collapse said flexible bags and eject said first liquids from said flexible bags and via said connecting conduits into said discharge conduit for mixture with said first liquids.

2. The system of claim 1 wherein the pressure of said second liquid is maintained at a substantially constant level by a constant flow valve.

3. The system of claim 2 wherein said constant flow valve is located exteriorly of said housing.

4. The system of claim 2 wherein said constant flow valve is located in said housing.

5. The system of claim 1 wherein said housing comprises a shipping carton, and wherein said carton and its contents are constructed and arranged for disposal upon exhaustion of said first liquids.

6. The system of claim 1 wherein metering orifices are provided in said connecting conduits.

7. The system of claim 1 wherein a metering orifice is provided between said supply conduit and said discharge conduit.

8. The system of claim 1 wherein said connecting conduits communicate with orifice tubes in said flexible bags.

9. A liquid mixing and dispensing system comprising:

a housing enclosing a chamber;

at least one container in said chamber;

a flexible bag in said at least one container;

a first liquid in said flexible bag;

a connecting conduit leading from said flexible bag to a discharge conduit; a check valve in said connecting conduit for preventing reverse liquid flow from said supply conduit into said flexible bag; and a constant flow valve through which a pressurized second liquid is delivered via a supply conduit to said at least one container and to said discharge conduit, said constant flow valve being normally closed, being opened in response to second liquid pressures above a lower threshold level, being operative at second liquid pressures between said lower threshold level and an upper threshold level to deliver said second liquid at a substantially constant pressure, and being closed in response to second liquid pressures above said upper threshold level, said pressurized second liquid serving to collapse said flexible bag and eject said first liquid from said flexible bag and via said connecting conduit into said discharge conduit for mixture with said first liquid.

* * * * *